US009370270B1

(12) United States Patent
Hsu

(10) Patent No.: US 9,370,270 B1
(45) Date of Patent: Jun. 21, 2016

(54) SIPPING STRAW SYSTEM AND METHOD OF USE

(71) Applicant: Wei K. Hsu, Plano, TX (US)

(72) Inventor: Wei K. Hsu, Plano, TX (US)

( * ) Notice: Subject to any disclaimer, the term of this patent is extended or adjusted under 35 U.S.C. 154(b) by 0 days.

(21) Appl. No.: 14/855,149

(22) Filed: Sep. 15, 2015

Related U.S. Application Data

(60) Provisional application No. 62/205,077, filed on Aug. 14, 2015.

(51) Int. Cl.
*A47G 21/18* (2006.01)

(52) U.S. Cl.
CPC ..... *A47G 21/187* (2013.01)

(58) Field of Classification Search
CPC ..... A47G 21/187; A47G 21/18; B65D 2543/00731; A01N 37/36
USPC ..... 239/16–33, 428.5
See application file for complete search history.

(56) References Cited

U.S. PATENT DOCUMENTS 2,943,794 A * 7/1960 Sussman ..... A47G 21/183 239/33
3,718,282 A * 2/1973 Pizzoferrato ..... A47G 21/183 239/33
3,773,256 A * 11/1973 Wright ..... A47G 21/18 137/150
3,972,326 A * 8/1976 Brawn ..... A63B 23/18 128/202.15
4,658,990 A * 4/1987 Ramage ..... A47G 21/18 141/18
4,688,721 A * 8/1987 Inaba ..... A47G 21/187 239/132
5,288,019 A * 2/1994 Gorochow ..... A47G 21/183 239/33
7,537,173 B1 * 5/2009 Kogan ..... A47G 21/187 239/16
2004/0046042 A1 * 3/2004 Judd ..... A47G 21/183 239/33
2005/0105831 A1 * 5/2005 Weber ..... B65B 3/045 383/40
2008/0169356 A1 * 7/2008 Trejo ..... A47G 21/18 239/33
2009/0250478 A1 * 10/2009 Roth ..... A47G 19/2266 220/703
2009/0283608 A1 * 11/2009 Crawley ..... A47G 21/18 239/33
2011/0127349 A1 * 6/2011 Srivatsan ..... A47G 21/185 239/33
2012/0056008 A1 * 3/2012 Claessens ..... A47G 21/18 239/33
2015/0034544 A1 * 2/2015 Aftoora ..... A47G 21/188 210/251

* cited by examiner

*Primary Examiner* — Arthur O Hall
*Assistant Examiner* — Chee-Chong Lee
(74) *Attorney, Agent, or Firm* — Eldredge Law Firm; Richard G. Eldredge; Brandon Leavitt

(57) ABSTRACT

A straw includes an elongated body extending from a first end to a second end, the elongated body with a hollow center and an outer surface; an opening extending through a thickness of the body and in fluid communication with the hollow center; and a sleeve slidingly engaged with the outer surface and configured to completely cover the opening.

3 Claims, 5 Drawing Sheets

SIPPING STRAW SYSTEM AND METHOD OF USE

BACKGROUND

1. Field of the Invention

The present invention relates generally to drinking straws, and more specifically, to sipping straws for hot liquids.

2. Description of Related Art

Drinking straw systems are well known in the art and are effective means to drink from glasses, mugs, and other dishware without having the need to come into physical contact with the container. FIG. 1 depicts a conventional drinking straw 101 having a cylindrical elongated body with a hollow center 102 with two open ends 103, 104. During use, and as depicted in FIG. 2, the user places one end 103 of the drinking straw system 101 in a glass 105 and drinks from the opposing end 104.

One of the problems commonly associated with system 101 is its use with hot liquids. For example, when hot liquid is drawn from the bottom of the glass 103 the liquid has not been adequately exposed to air and could therefore could cause discomfort to the user.

Accordingly, although great strides have been made in the area of drinking straw systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 2:
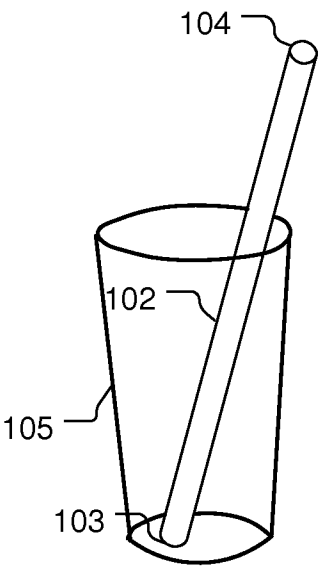
FIG. 2 (Prior Art)
FIG. 2 is a front view of a common drinking straw system in use.
Figure 1:
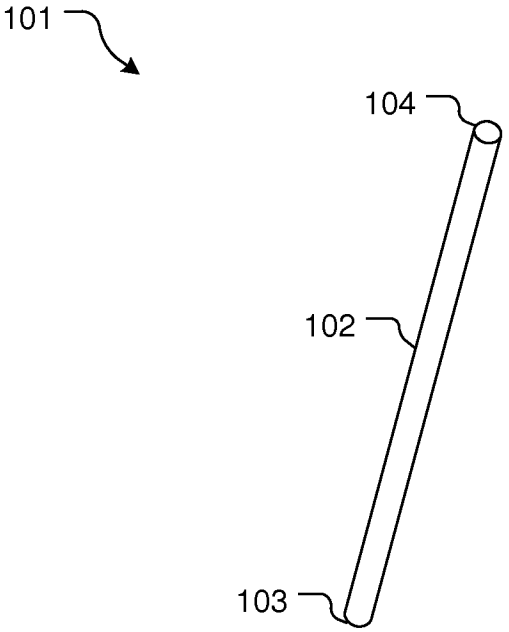
FIG. 1 (Prior Art)
FIG. 1 is a front view of a common drinking straw system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional drinking straw systems. Specifically, the system and method of the present application provides a safe and effective means to drink from most temperature beverages. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figures 3A, 3B:
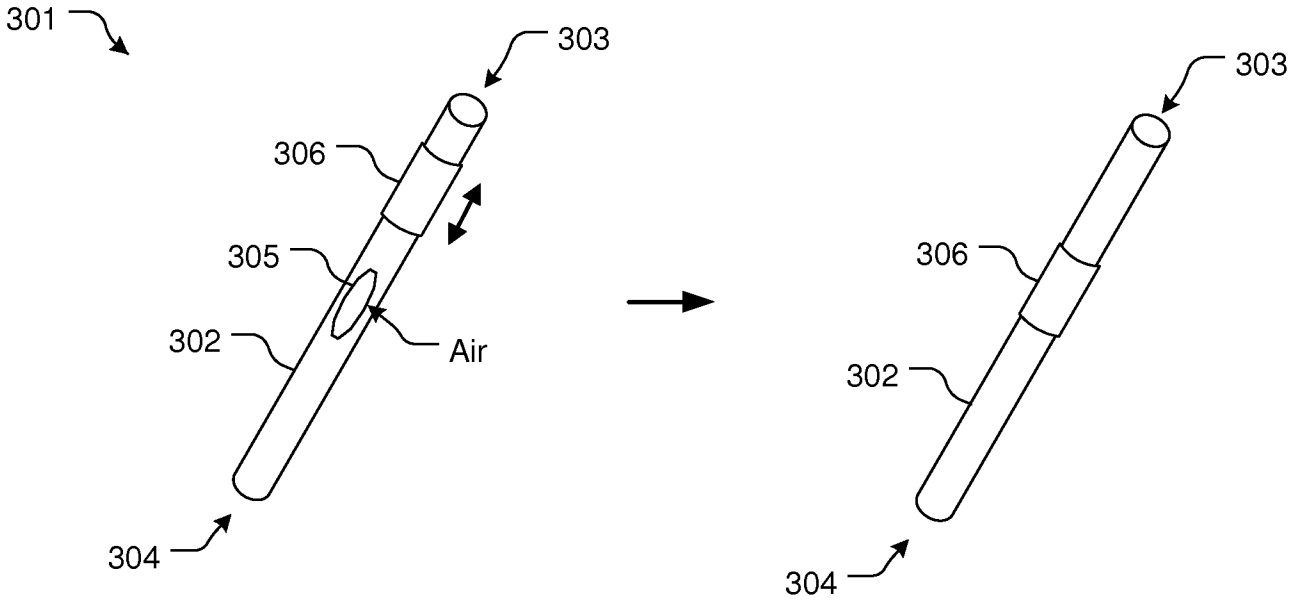
FIGS. 3A and 3B are front views of a drinking straw system in accordance with a preferred embodiment of the present application with an air flow restricting feature up and down respectively.

Referring now to the drawings wherein like reference characters identify corresponding or similar elements throughout the several views, FIGS. 3A and 3B depict front views of a drinking straw system 301 for use in varying temperatures in accordance with a preferred embodiment of the present application. It will be appreciated that system 301 overcomes one or more of the above-listed problems commonly associated with conventional drinking straw systems.

In the contemplated embodiment, system 301 includes an elongated cylindrical body 302 with a hollow center in fluid communication with two open ends 303, 304. The center of body 302 is in communication with an opening 305 extending through the thickness of the body 302 and a sleeve 306 that engages with body 302 and slides relative thereto as depicted with an arrow. During use, one end 304 is placed in a liquid and a user inhales from the other end 303, and thereafter, the sleeve 306 is manually manipulated to cover the opening 305. In the contemplated embodiment, the sleeve 306 peripherally extends around the outer surface of the body and is held in place via a snug friction force between the inner surface of the sleeve and outer surface of the body.

It should be appreciated that one of the unique features believed characteristic of the present application is that system 301 can safely and effectively be used to drink beverages of most temperatures. For example, when the user wants to drink a hot liquid, such as coffee, tea, or soup, system 301 allows air to mix with the liquid through opening 305, thereby cooling the liquid as it travels through system 301. It is contemplated that the system discussed herein could include multiple openings 305 along with multiple sleeves 306.

As depicted in FIG. 3B, another unique feature believed characteristic of the present application is the sleeve 306 which can be used to cover the opening 305 when the user wants to drink a liquid that does not require cooling. It should be appreciated that this characteristic allows system 301 to be used in various temperatures thereby increasing the functionality of system 301. In the preferred embodiment of the present application, it is contemplated that the sleeve 306 may be comprised of a hollow cylinder that can slide securely over the opening 305. However, alternative embodiments contemplate any feature, whether removable or permanent, capable of restricting air flow.

Alternative embodiments of the present application further contemplate that system 301 may be permanently incorporated into dishware and that the size, shape, and material of system 301 may vary as functional, manufacturing, or aesthetic considerations require.

Although shown as a sleeve and opening feature to reduce the temperature of the fluid passing though the elongated body, it is also contemplated having different means to achieve the same results in an alternative embodiment.

Figure 4B:
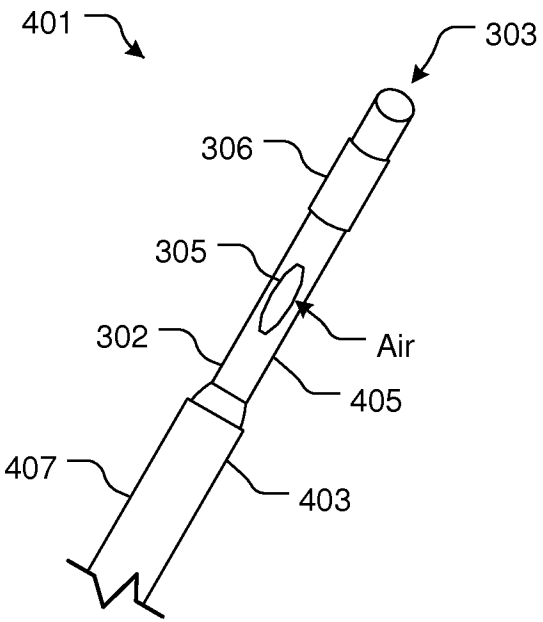
FIGS. 4A and 4B are oblique views of a drinking straw in accordance with an alternative embodiment of the present application.
Figure 4A:
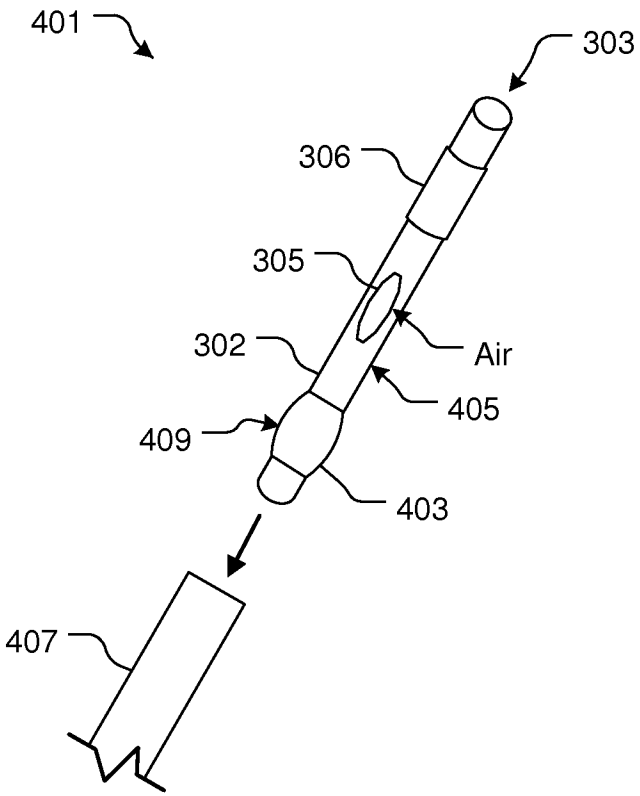

Referring now to FIGS. 4A and 4B, oblique views of a system 401 is shown in accordance with an alternative embodiment of the present application. In this embodiment, the system 401 is further provided with an attachment device 403 configured to peripherally extend around the outer surface 405 of body 302 and configured to engage with an inner surface of a straw 407 via an outer surface 409. The inner surface of the straw and outer surface of the device 403 creates a snug friction lock between the system and straw. It will be appreciated that device 403 is contoured to engage with straws having different diameters and is preferably composed of an elastomeric material to create the snug fit.

Alternative embodiment could include different shapes and sizes in lieu of what is shown as device 403. For example, an alternative embodiment could include a wedge shaped device in lieu of the contemplated embodiment.

As shown herein, it will be appreciated that the features of the systems 301, 401 could be adapted for use with a straw, as shown in FIGS. 4A and 4B, or to be used in lieu of a straw, as shown in FIGS. 3A and 3B.

Figure 5:
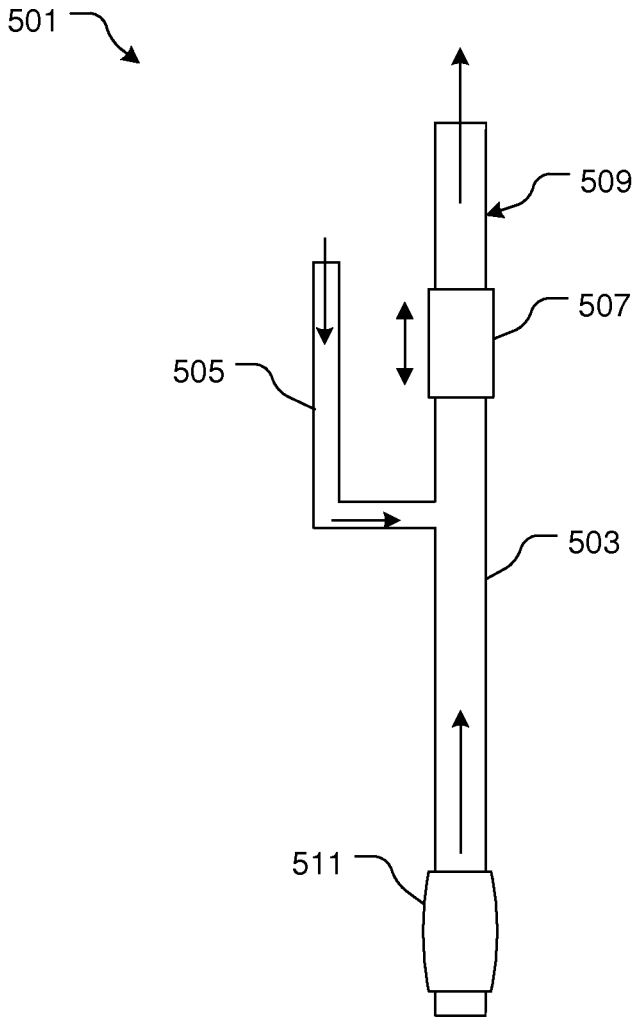
FIG. 5 is an oblique view of an alternative embodiment of the present application.

In FIG. 5, a system 501 is shown in accordance with yet another embodiment of the present application. System 501 includes one or more of the features of systems 301, 401 discussed above.

In the contemplated embodiment, system 501 includes a body with a first channel 503 and a second channel 505 integrally attached thereto and in fluid communication with the hollow center extending through channel 503. Like the systems discussed above, the system 501 includes an opening with a sleeve 507 that extends there over and engages with an outer surface 509. The system 501 is further provided with an attachment device 511 to secure to a straw.

Figure 6B:
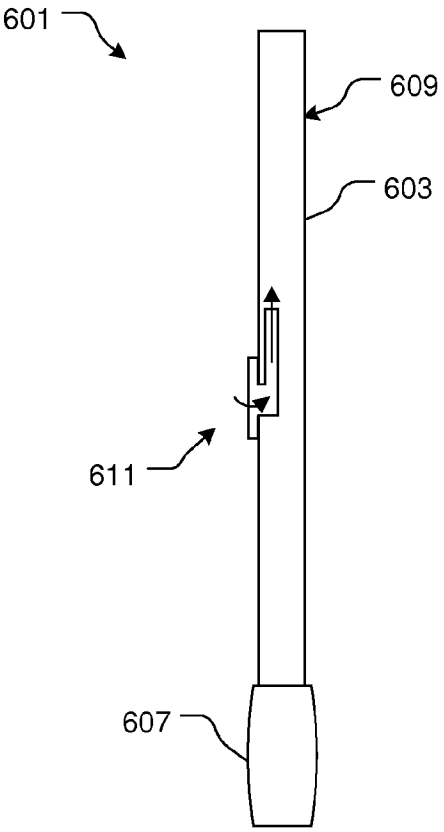
FIGS. 6A and 6B are front views of alternative embodiments of the present application.
Figure 6A:
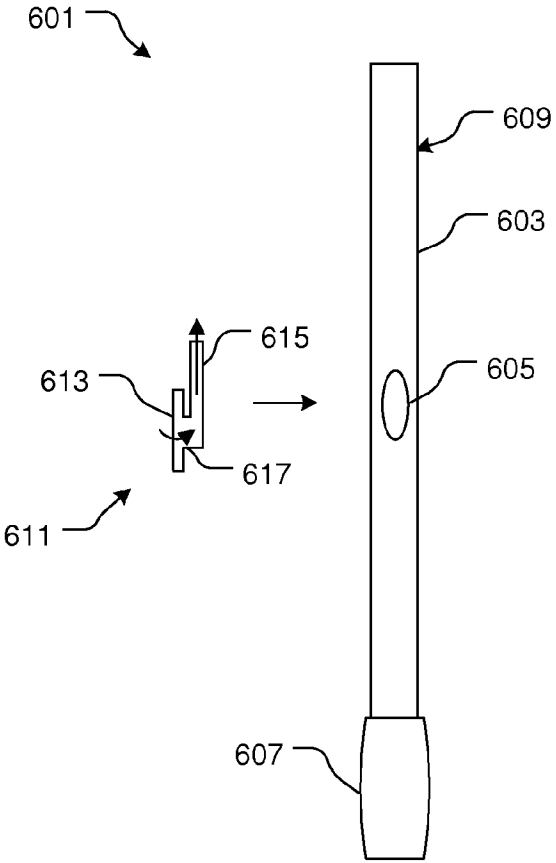

Referring now to FIGS. 6A and 6B, front views of an alternative embodiment is shown. In the contemplated embodiment, system 601 includes a straw with an elongated body 603 having a hollow cylinder therein and in fluid communication with an opening 605. Like the above-mentioned embodiments, the system 601 also includes an attachment device 607 configured to engage with a straw and secured to an outer surface 609 of body 603. Although not shown, attachment device 607 includes a contoured inner surface area adapted to engage with straws having different diameters.

One of the unique features believed characteristic of system 601 is the ability to secure an airway device 611 to opening 605. To achieve this feature, airway device 611 includes a base 613 sized larger than opening 605, a neck 617 extending relatively perpendicular to base 613, and a channel 615 secured to the neck 617 and extending relatively parallel to base 613. It should be understood that the members of airway device 611 are in fluid communication with each other and provide air passage therethrough, as depicted with arrows. As shown in FIG. 6B, the airway device is adapted to fit within the opening 605 in a secured position.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A beverage drinking straw for cooling beverages, comprising:

an elongated body extending from a first end to a second end, the elongated body having:

a hollow center;

an outer surface;

a first elongated channel; and a second elongated channel integral with the first elongated channel;

an opening extending through a wall thickness of the body and in fluid communication with the hollow center; and an attachment device secured to the outer surface of the first end of the elongated body;

wherein the attachment device is configured to secure to an inner surface of a second straw;

a removable airway device configured to engage with the opening;

the airway device comprising:

a base configured to engage with the outer surface of the body;

a neck extending from the base and configured to extend through the opening;

a channel attached perpendicular to the neck and parallel to the elongated body directing toward the second end and configured to extend within the hollow center;

wherein the airway device provides air passage to the hollow center.

2. The beverage drinking straw of claim 1, wherein the attachment device is composed of an elastomeric material.

3. The beverage drinking straw of claim 1, wherein the attachment device has a contoured outer surface.

* * * * *